US010071382B1

(12) United States Patent
Ebadian et al.

(10) Patent No.: US 10,071,382 B1
(45) Date of Patent: Sep. 11, 2018

(54) SOLID STATE DRIVE DISINTEGRATOR

(71) Applicant: Phiston Technologies, Inc., Miami, FL (US)

(72) Inventors: M. Ali Ebadian, Miami, FL (US); Raul Travieso, Miami, FL (US); William Olliges, Palm City, FL (US)

(73) Assignee: Phiston Technologies, Inc., Miami, FL (US)

( * ) Notice: Subject to any disclaimer, the term of this patent is extended or adjusted under 35 U.S.C. 154(b) by 0 days.

(21) Appl. No.: 15/654,095

(22) Filed: Jul. 19, 2017

(51) Int. Cl.

| | |
|---|---|
| ***B02C 18/22*** | (2006.01) |
| ***B02C 18/00*** | (2006.01) |
| ***B02C 18/14*** | (2006.01) |
| ***B02C 25/00*** | (2006.01) |
| ***B02C 18/16*** | (2006.01) |
| *B02C 18/18* | (2006.01) |

(52) U.S. Cl.
CPC ..... *B02C 18/2233* (2013.01); *B02C 18/0007* (2013.01); *B02C 18/14* (2013.01); *B02C 18/22* (2013.01); *B02C 18/2216* (2013.01); *B02C 18/2291* (2013.01); *B02C 25/00* (2013.01); *B02C 2018/0015* (2013.01); *B02C 2018/164* (2013.01); *B02C 2018/188* (2013.01)

(58) Field of Classification Search
CPC . B02C 18/0084; B02C 18/2291; B02C 18/22; B02C 18/2225; B02C 18/2233
USPC ..... 241/36, 282, 280, 242, 243
See application file for complete search history.

(56) References Cited

U.S. PATENT DOCUMENTS

| | | | | |
|---|---|---|---|---|
| 3,995,768 | A * | 12/1976 | Montalbano | A61M 5/3278 221/197 |
| 5,090,628 | A * | 2/1992 | Porter | B23Q 11/0057 241/100 |
| 5,302,078 | A * | 4/1994 | Essick | E05B 73/0023 206/1.5 |
| 5,884,855 | A * | 3/1999 | Chang | B02C 18/0007 241/186.2 |
| 6,565,026 | B1 * | 5/2003 | Hall | B02C 18/145 241/225 |
| 7,267,294 | B2 | 9/2007 | Castronovo | |
| 7,270,282 | B2 | 9/2007 | Castronovo | |
| 7,324,321 | B2 | 1/2008 | Olliges | |
| 7,334,747 | B2 | 2/2008 | Castronovo | |
| 7,357,340 | B2 | 4/2008 | Castronovo | |
| 7,424,981 | B2 | 9/2008 | Castronovo | |
| 7,448,562 | B2 | 11/2008 | Castronovo | |
| 7,500,625 | B2 | 3/2009 | Castronovo | |
| 7,852,590 | B1 | 12/2010 | Olliges | |
| 8,064,183 | B2 | 11/2011 | Olliges | |
| 2006/0016919 | A1 * | 1/2006 | Castronovo | B02C 18/0007 241/34 |

(Continued)

OTHER PUBLICATIONS

Google Definition Search—Tang.*

*Primary Examiner* — Jessica Cahill
*Assistant Examiner* — Joseph Finan, Jr.
(74) *Attorney, Agent, or Firm* — McHale & Slavin, P.A.

(57) ABSTRACT

A device to reduce solid state drives (SSD) and the like digital media storage devices into particles less than 2 mm maximum edge length. The device is particularly adapted to disintegrating 1.8" and 2.5" solid state drives at a rate of about 360 HDD/hr or 720 SSD/hr with a throughput of about 10 seconds. A blade assembly is designed to provide multiple cutting angles while rotating at 520 rpm to maintain a low decibel rating.

18 Claims, 23 Drawing Sheets

(56) References Cited

U.S. PATENT DOCUMENTS

| | | | | |
|---|---|---|---|---|
| 2007/0075168 | A1* | 4/2007 | Rodriguez | B02C 18/0007 241/36 |
| 2013/0320121 | A1* | 12/2013 | Ko | B02C 23/02 241/63 |
| 2014/0209723 | A1* | 7/2014 | Ebadian | B02C 18/24 241/35 |

* cited by examiner

SOLID STATE DRIVE DISINTEGRATOR

FIELD OF THE INVENTION

This invention is related to the field of sensitive material destruction and, in particular, to an apparatus for disintegrating solid state drives containing sensitive material into fine particles.

BACKGROUND OF THE INVENTION

Sensitive information is commonly stored on solid state drives, hard disks, floppy disks, and USB storage memory devices. While degaussing is a known process to erase digital data, the only way to ensure the digital data is destroyed is by disintegration of the memory device.

Known prior art by the Applicant includes a number of patents for data destroying devices, including U.S. Pat. No. 7,324,321 for a Degaussing Apparatus; U.S. Pat. No. 7,852,590 for a Solid State Memory Decommissioner; and U.S. Pat. No. 8,064,183 for a Capacitor Based Bi-Directional Degaussing Apparatus With Chamber.

U.S. Pat. No. 7,267,294 and related U.S. Pat. Nos. 7,270,282; 7,334,747; 7,424,981 and 7,448,562 by Castronovo disclose a zero tolerance cutting system for paper, CDs, DVDs, Polyester, plastic cards, SMART cards, wood, and other generally planar materials. The cutting system includes a cutting blade, typically a rotary cutter, and a sacrificial plate or round bar contacting the cutting blade. The contacting portion has zero clearance during the cutting operation. A metering mechanism is also provided, which is capable of metering the material at a predetermined rate to the cutting blade.

U.S. Pat. No. 7,357,340 and U.S. Pat. No. 7,500,625 disclose the use of a rotary scissor action, where one curved blade of the scissors rotates and the other is stationary. In this arrangement, the feed angle and position are critical. Rubber rollers feed and position the material being fed to the cutters. Deviation of the feeding angle and position will cause the scissor blades to bind.

What is needed in the industry is a device capable of disintegrating solid state drives into particles less than 2 mm to ensure no aspect of the memory device is recoverable. Such a device must be of an acceptable weight, that is less than 500 lbs., and operate at a decibel level that is appropriate for a working environment.

SUMMARY OF THE INVENTION

Disclosed is a device to reduce solid state drives (SSD), and the like digital media storage devices, containing sensitive materials into particles less than 2 mm maximum edge length. The device is particularly adapted to destroying 1.8" and 2.5" solid state drives at a rate of about 360 HDD/hr or 720 SSD/hr with a throughput of about 10 seconds. A rotor is designed to provide multiple cutting angles while rotating at 520 rpm to maintain a low decibel rating.

Gap distance between a rotor blade and the cutting blades is 0.8 mm; gap distance between a rotor blade and a perforated screen sidewall for removal of material is 0.4 mm. The device enables increased efficiency and reliability over the known prior art by utilizing a minimal amount of moving parts and a flywheel type weight, enabling the device to cut materials into fine particles that can be removed with a conventional vacuum cleaner, preferably a Shop-Vac type cleaner.

Accordingly, it is an objective of the instant invention to provide a solid state drive disintegrator capable of destroying aluminum casted cases by use of a rotary cutting blade that has a flywheel attached. The cutting blades have cutting edges which allow for shearing, grating, and pumping of material to a following shearing zone and exhausting of particles through the screen.

It is a further objective of the instant invention to have an offset rotor knife to cooperate with cutting blades to cause cutting at various angles to ensure quick destruction through shearing.

It is a still further objective of the invention to include a screen that cooperates with the rotary cutter in order to grate material, as well as filter it through 2 mm diameter holes.

It is a further objective of the instant invention to include vacuum ports designed to be operated with Shop-Vac type cleaners.

It is yet another objective of the instant invention to disclose an automatic feeding device that batches up to 50 SSD.

Another objective of the invention is to disclose a device for disintegrating SSD memory storage devices having noise suppression to less than 70 db.

Yet another objective of the invention is to disclose a device for disintegrating SSD memory storage devices that detects media feed jams and can automatically reverse the feed to unjam media.

An objective of the invention is to meet or exceed the NSA/CSS Policy Manual 9-12 of Dec. 15, 2014, regarding disintegration and sanitization of solid state drive storage devices.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
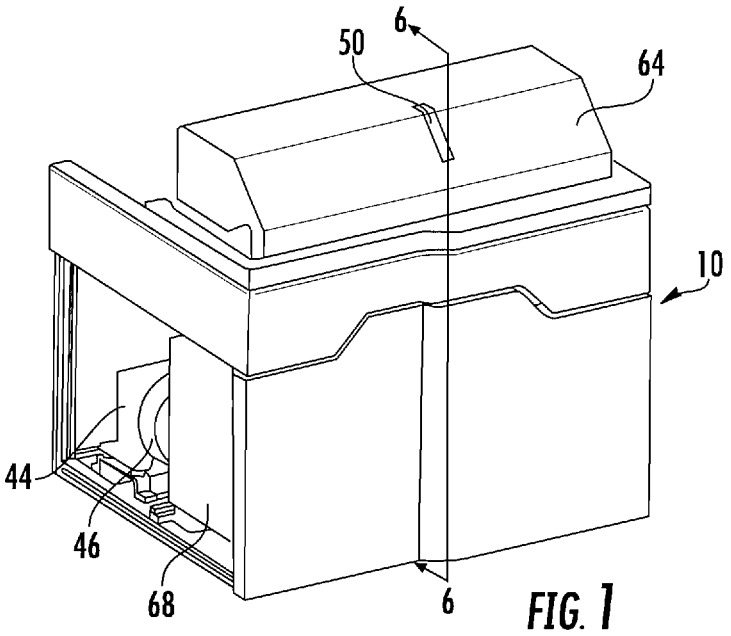
FIG. 1 is a perspective view of a first embodiment of the SSD disintegrator of the instant invention.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Figure 2:
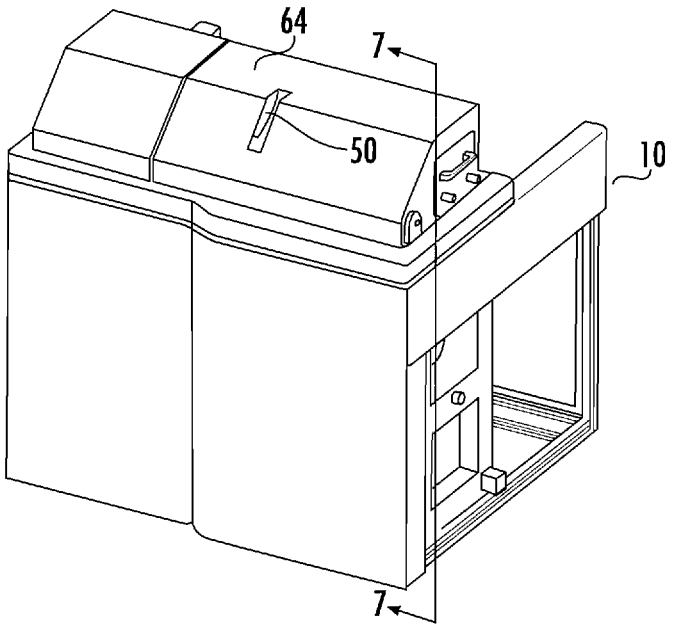
FIG. 2 is an alternate perspective view of the SSD disintegrator of FIG. 1.
Figure 3:
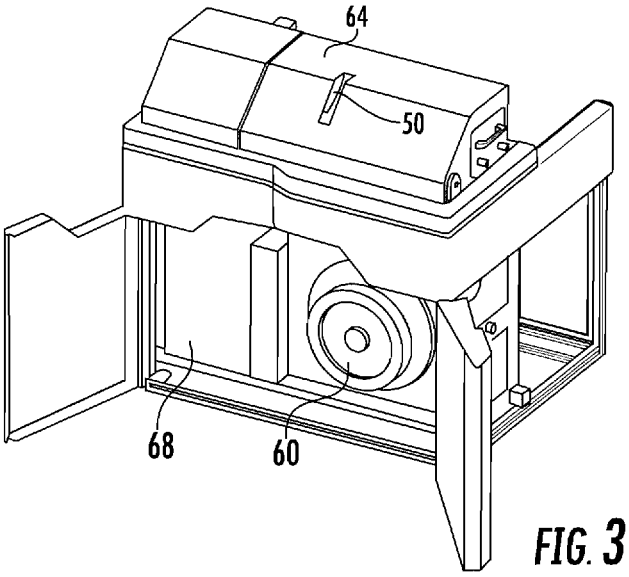
FIG. 3 is a perspective view of the SSD disintegrator of FIG. 1 with front doors open.
Figure 4:
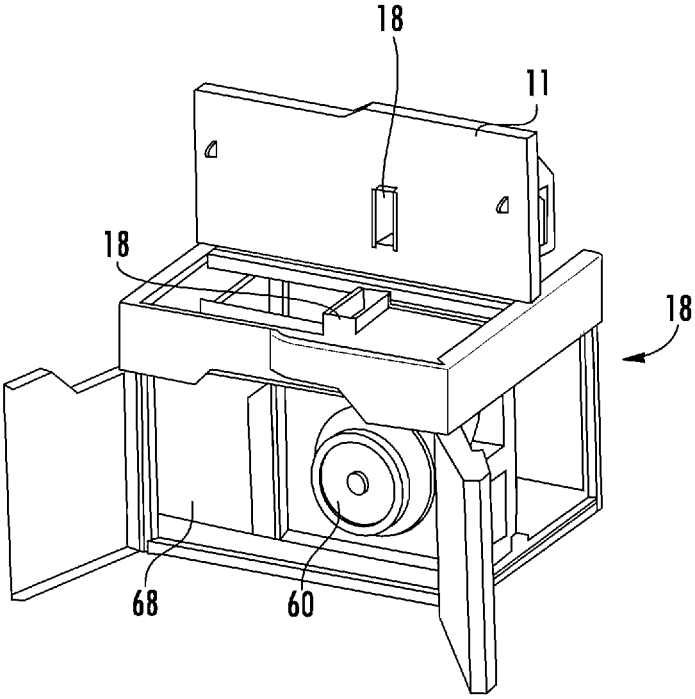
FIG. 4 is a perspective view of the SSD disintegrator of FIG. 3 with the top panel lifted.
Figure 5:
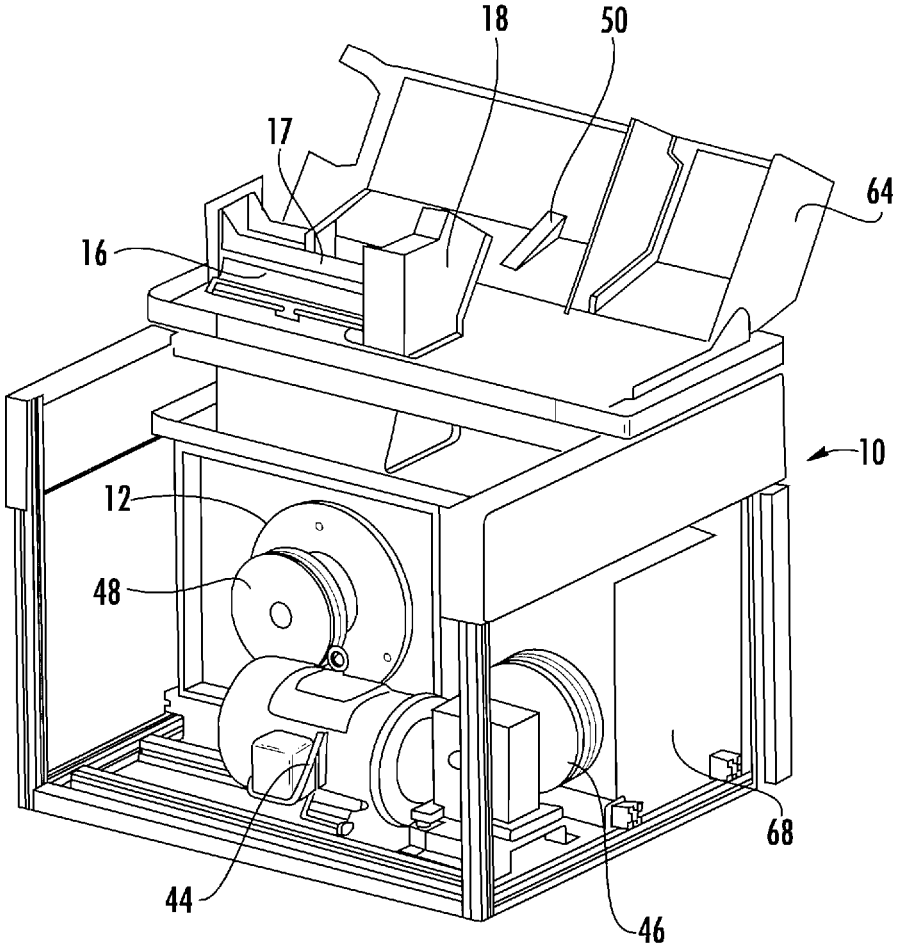
FIG. 5 is a rear perspective view of the SSD disintegrator of FIG. 1 with the cover open.
Figure 6:
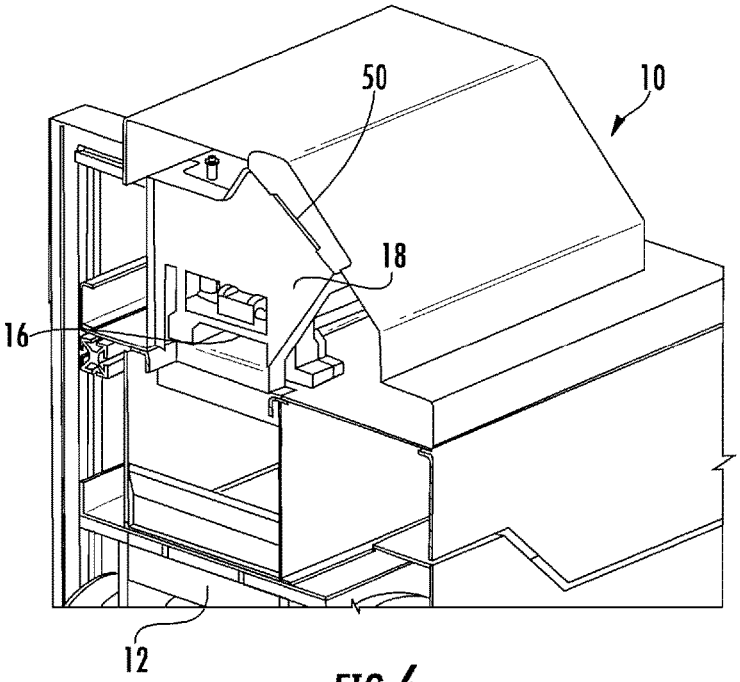
FIG. 6 is a perspective view of a cross section of the SSD disintegrator of FIG. 1 taken at cut 6-6.
Figure 7:
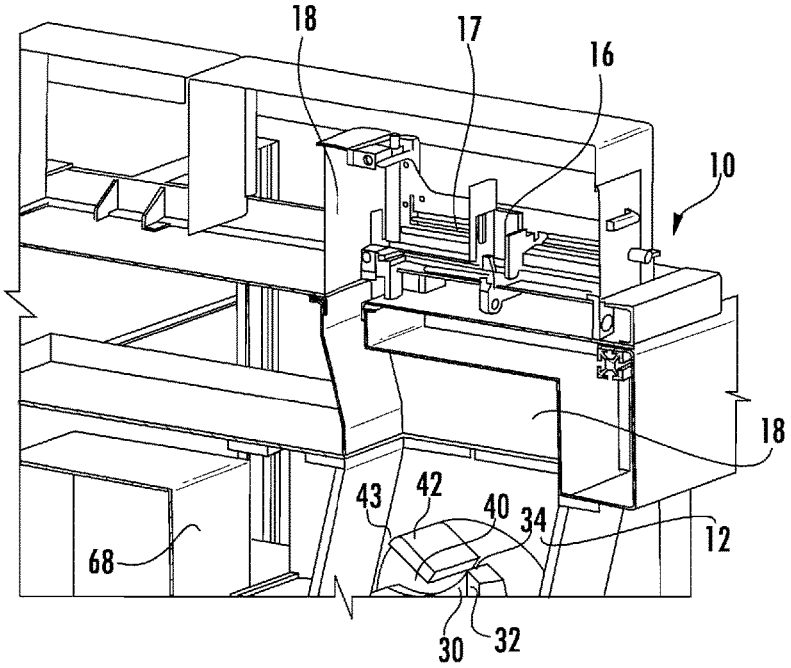
FIG. 7 is a perspective view of a cross section of the SSD disintegrator of FIG. 2 taken at cut 7-7.
Figure 8:
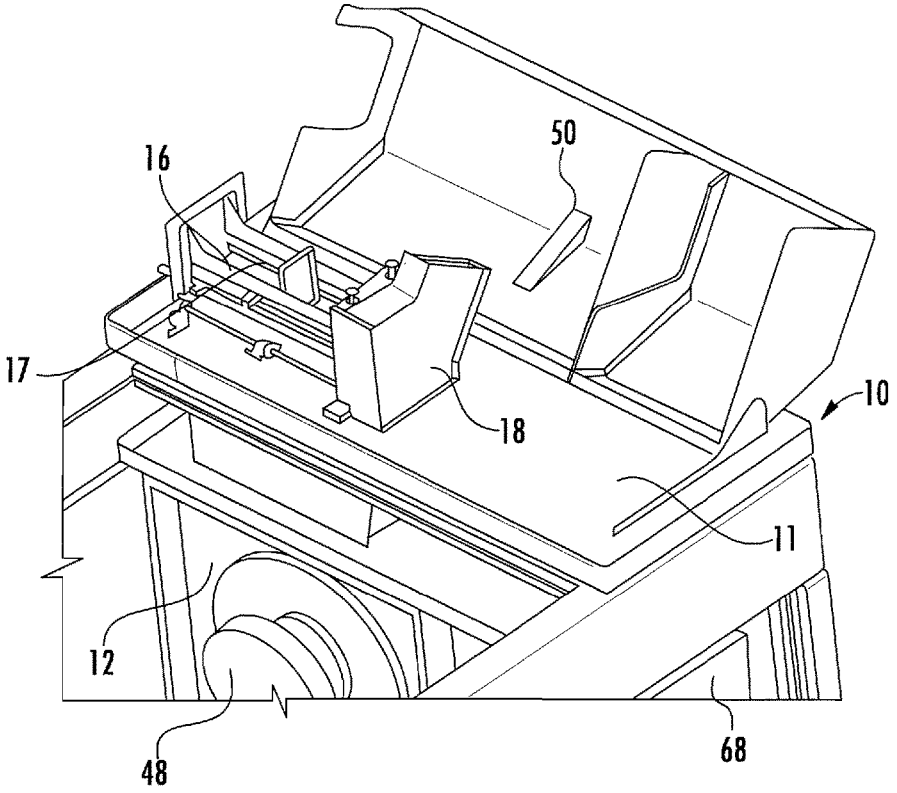
FIG. 8 is a perspective view of the SSD disintegrator of FIG. 5.
Figure 9:
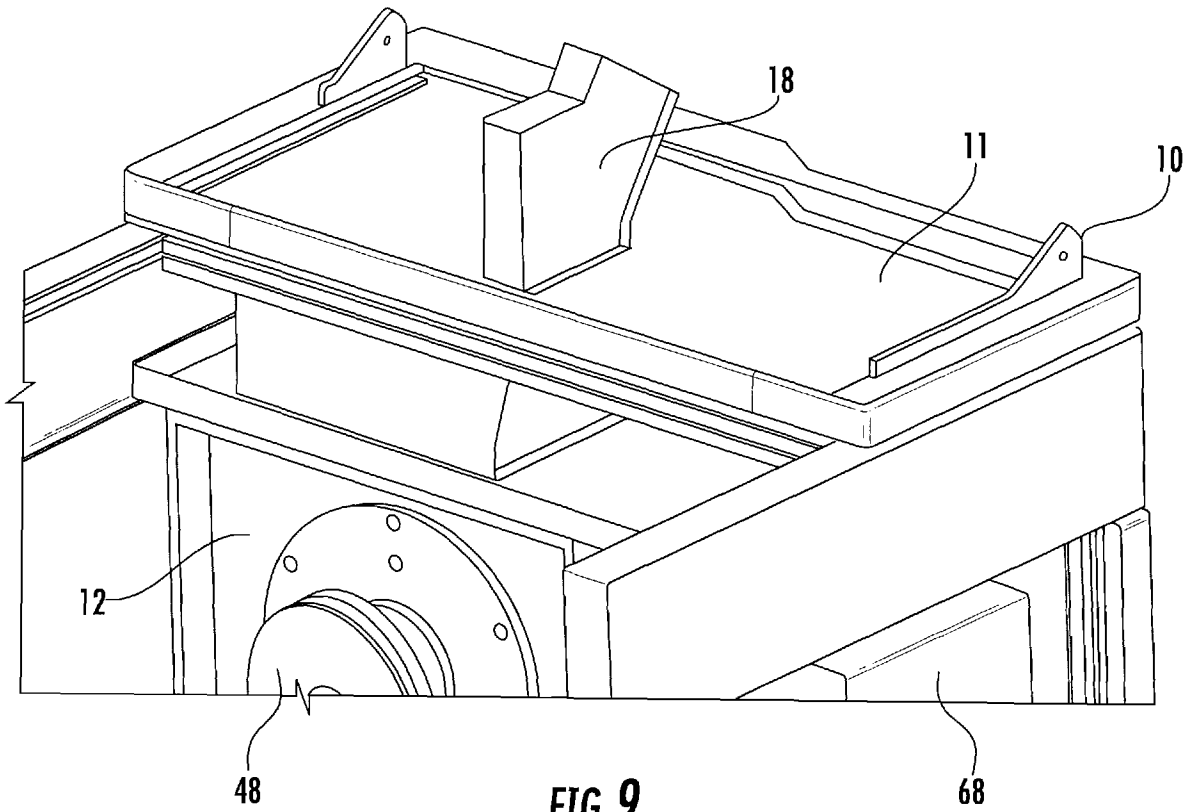
FIG. 9 is a perspective view of the top of the SSD disintegrator housing with autoloader and cover removed.
Figure 10:
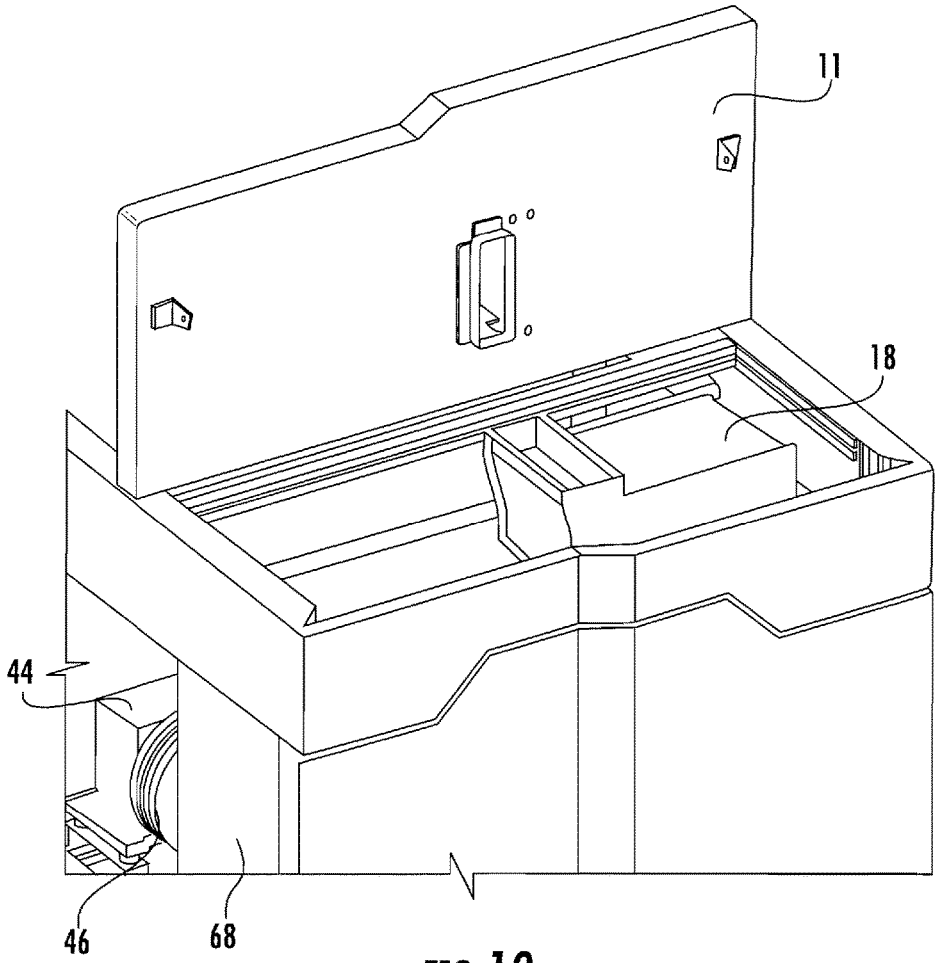
FIG. 10 is a perspective view of the top panel connection of the SSD disintegrator of FIG. 9.
Figure 11:
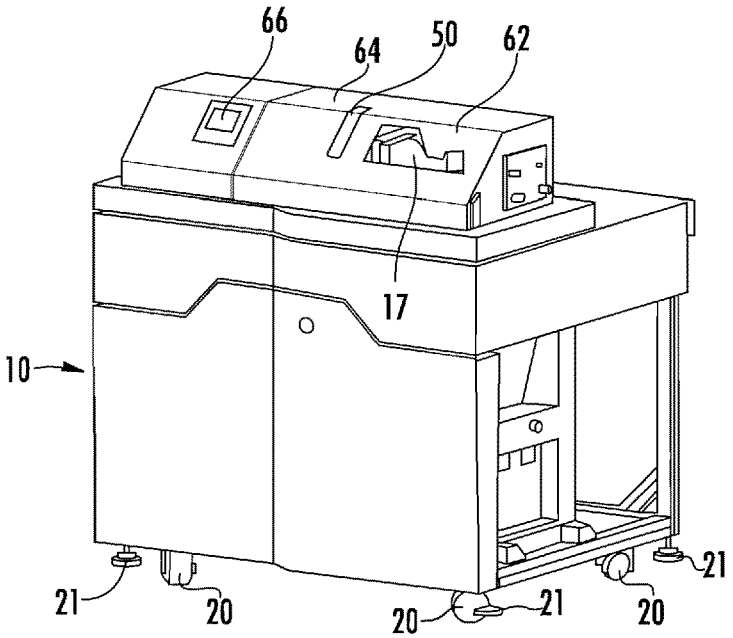
FIG. 11 is a perspective view of the SSD disintegrator of the instant invention with an alternate cover.
Figure 12:
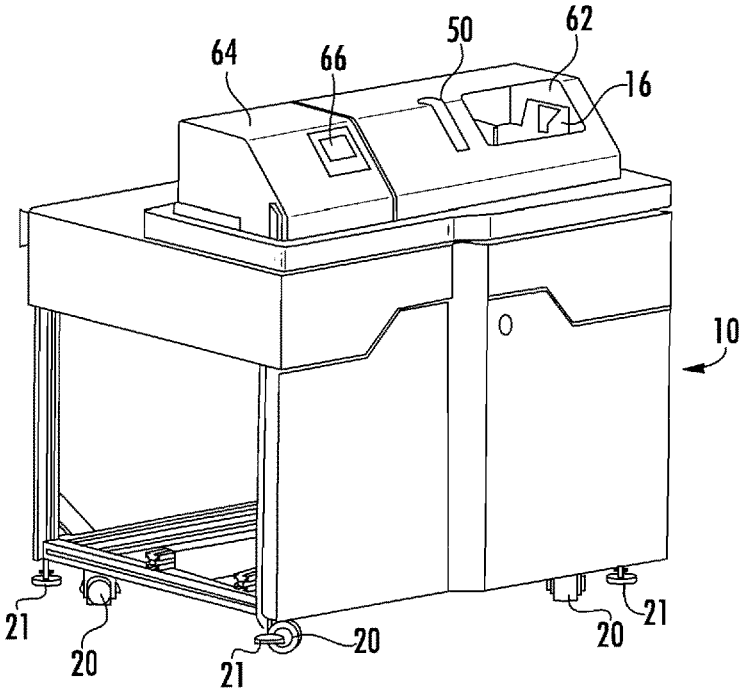
FIG. 12 is an alternate perspective view of the SSD disintegrator of FIG. 11.
Figure 13:
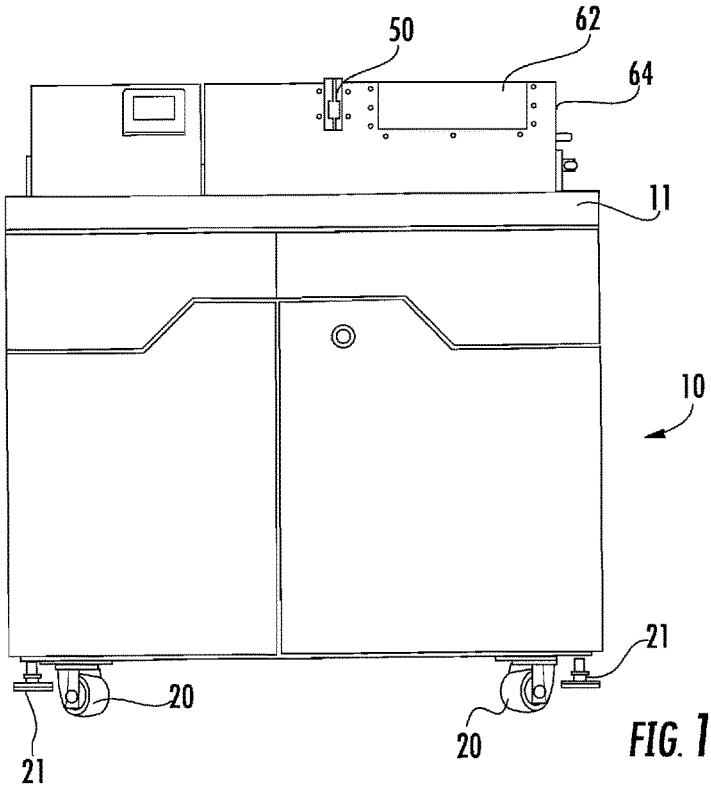
FIG. 13 is front plane view thereof.
Figure 14:
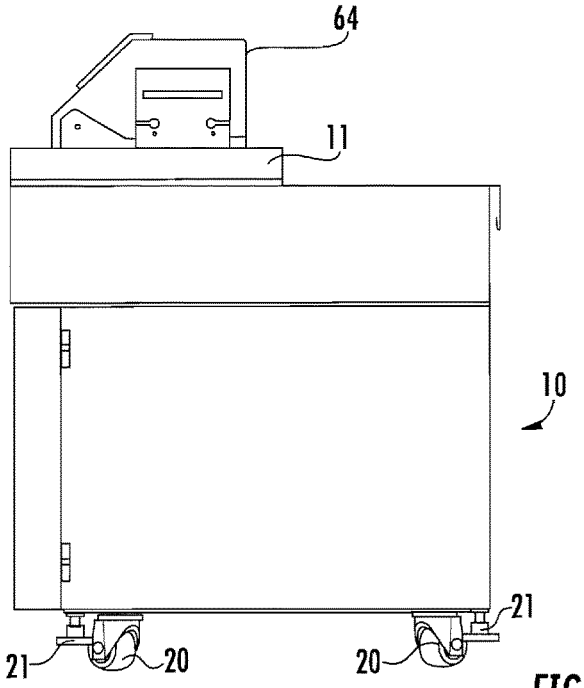
FIG. 14 is a side view thereof.
Figure 15:
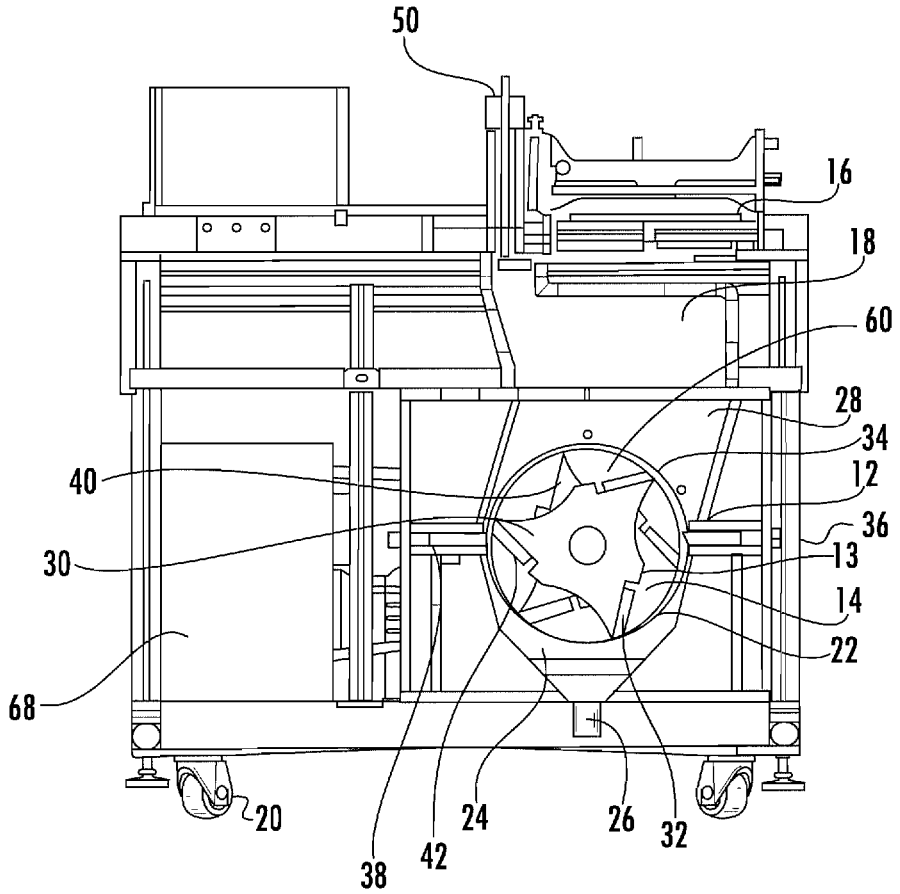
FIG. 15 is a cross sectional front view thereof.

Referring to FIGS. 1-15, disclosed is a device for disintegrating solid state drives (SSD) consisting of a housing having a chamber 12 with a blade assembly 14 positioned beneath an autoloader 16 for feeding SSD cassettes into a drop chute 18 for purposes of engaging the blade assembly 14. The housing 10 has a compact size of less than 44"H×42"W×34"D, and can be as compact as 44"H×25"W×23"D, but is capable of disintegrating up to 360 SSDs per hour (a rate of one SSD every 10 seconds). The disintegration results in SSD cassette cases, typically made out of aluminum, being shredded into pieces having a 2 mm nominal edge length or less. The housing 10 is portable, using casters 20, allowing ease of movement. Feet 21 can also be employed to help fix the position of the housing 10 once move into a desired position.

By use of a blade assembly 14 boosted by a flywheel 60, the device shreds metal SSDs at a high rate with noise suppression to less than 70 decibels, well beneath the OSHA threshold level of 85 decibels considered acceptable for workplaces. The chamber 12 is formed from a continuous sidewall 13 having a plurality of 2 mm apertures 22 that operate as a screen to allow only properly shredded particles to exit through the apertures 22 into a holding area 24 for collection. The apertures 22 are located only along a portion of the sidewall 13 to ensure the screened particles are passed into the holding area 24. As the materials have been shredded into such a small size, the holding area 24 may either be used to hold multiple shredded disks for later removal, or be removed by use of a vacuum, such as a dry-vac (not shown). The dry-vac would be attached to the holding area 24 by securement to an outlet 26 for ease of waste removal. A HEPA filter 28 is constructed and arranged to trap any airborne particles created during the shredding process. While the aluminum shreds cleanly, the destruction of the SSD includes the disintegration of circuit boards, electronic components, silicone based memory and integrated circuit chips. The HEPA filter 28 ensures that airborne particles do not leave the device during the disintegration process.

The blade assembly 14 consists of a first rotor 30 having three blades 32 placed around the perimeter of the rotor with a leading edge 34 of each blade set at 60° relative to cutting blades or knives 36,38, designed to operate in conjunction with cutting knives 36 and 38. A second rotor 40 contains blades 42 placed around the perimeter, also with a 60° blade angle, and a leading edge 43, for use in cooperation with cutting knives 36 and 38.

In the preferred embodiment, the first rotor 30 is offset from the second rotor 40 by approximately 90°; wherein SSDs placed through a drop chute 18, by either the autoloader 16 or through a manual drawer 50, fall into the chamber 12 between the blades 32 of the first rotor 30 and the blades 42 of the second rotor 40. As the rotors 30,40 spin, each SSD is forced into various angular positions so as to cause shearing between the rotor blades and the cutting blades. The rotors are rotated at a speed of about 520 rpm's, plus or minus 5 percent, using a step-down gearing 46,48 from 3 HP or 5 HP electric motor 44, depending upon expected workload. A flywheel 60 is attached to the rotors 30,40 to provide additional momentum to inhibit jamming. In the preferred embodiment, the flywheel 60 weighs 45 kgs to ensure continued rotation of the rotors to handle most anticipated loaded.

A controller CPU 68 includes a current sensor coupled to the electric motor 44 for detection if a jam occurs. Should a jam occur, the electric motor 44 is reversed to relieve the rotor from the jam, and the system is restarted upon freedom from the jam. Should the rpm's of the rotor exceed 600 rpm's for a period of more than 60 seconds, the unit will automatically turn off, as it has detected a no-load condition.

The rotors 30,40 are particularly designed to engaged 1.8 inch and 2.5 inch solid state drives. However, the manual drawer 50 will also accept SIM cards, flash cards, CAC ID, EMV credit cards, magnetic strip cards, CDs, DVDs, Blue Rays, circuit boards and flash drives. At a rate of one solid state drive for disintegration in less than 10 seconds from loading to being in condition for discharge, the blades and knifes can handle up to 100,000 cycles before replacement or requiring sharpened.

The holding chamber 24 is constructed and arranged to hold up to 50 destroyed SSDs. The size of the device is less than a conventional office copier, with a foot print of 42"W×34"D. The weight of the device is 450 lbs for a 100 volt operation, and 465 lbs for a 220 volt operation. The height of the device is 44", providing ease of access to the top mounting autoloader 16 or chute door 52. A cover 64 for the autoloader is hinged, allowing ease of access to cassette 17. The autoloader 16 is mounted to a top panel 11, that is mounted to the housing 10. Operation of the autoloader 16 may be viewed through a window opening 62 placed within the cover 64. If SSDs are not placed on a cassette 17, as explained later in this specification, they may be manually fed through the drop chute 18 directly into the chamber. An interface 66 is provided to access the CPU 68 to adjust any necessary settings.

Figure 16:
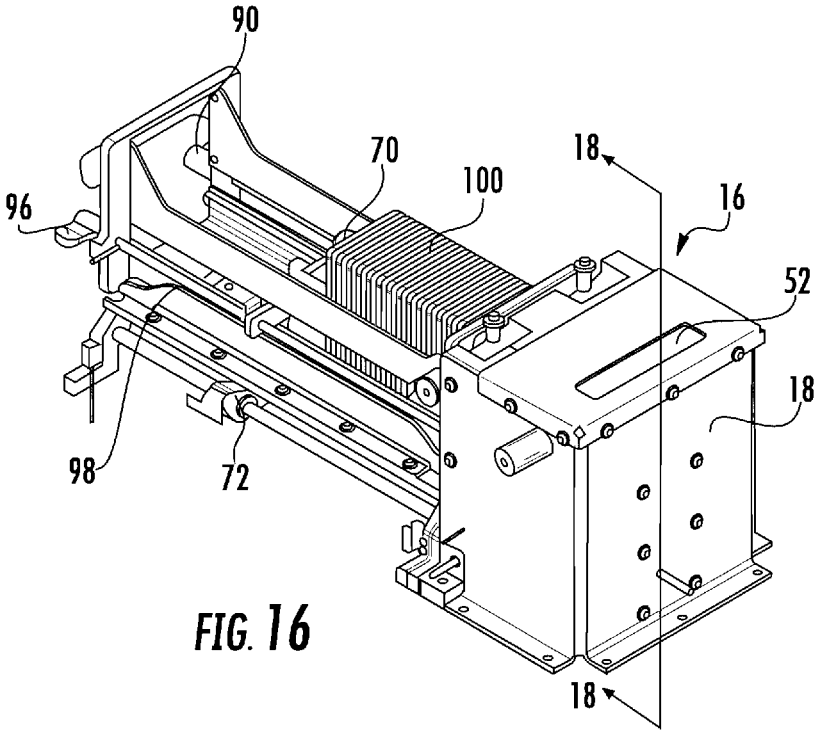
FIG. 16 is a perspective view of the autoloader.
Figure 17:
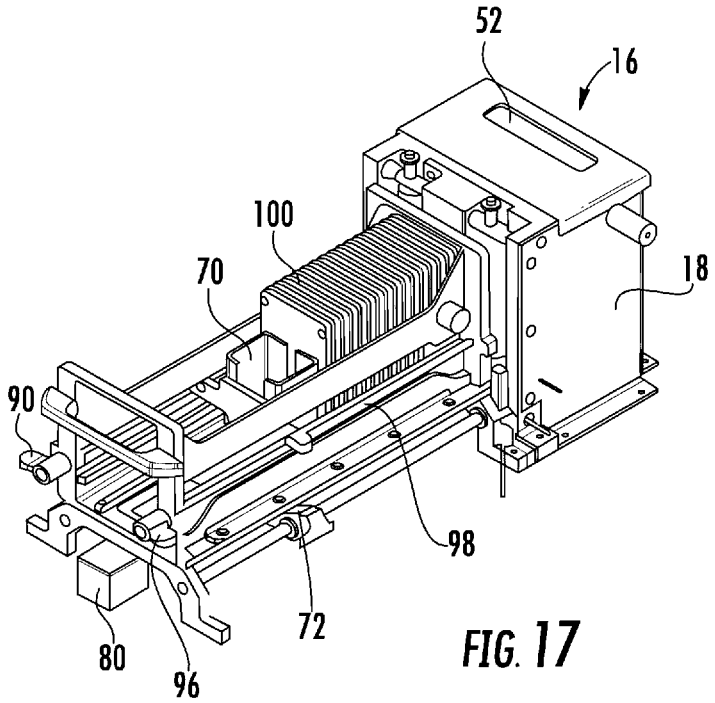
FIG. 17 is an alternate perspective view of the autoloader of FIG. 16.
Figure 18:
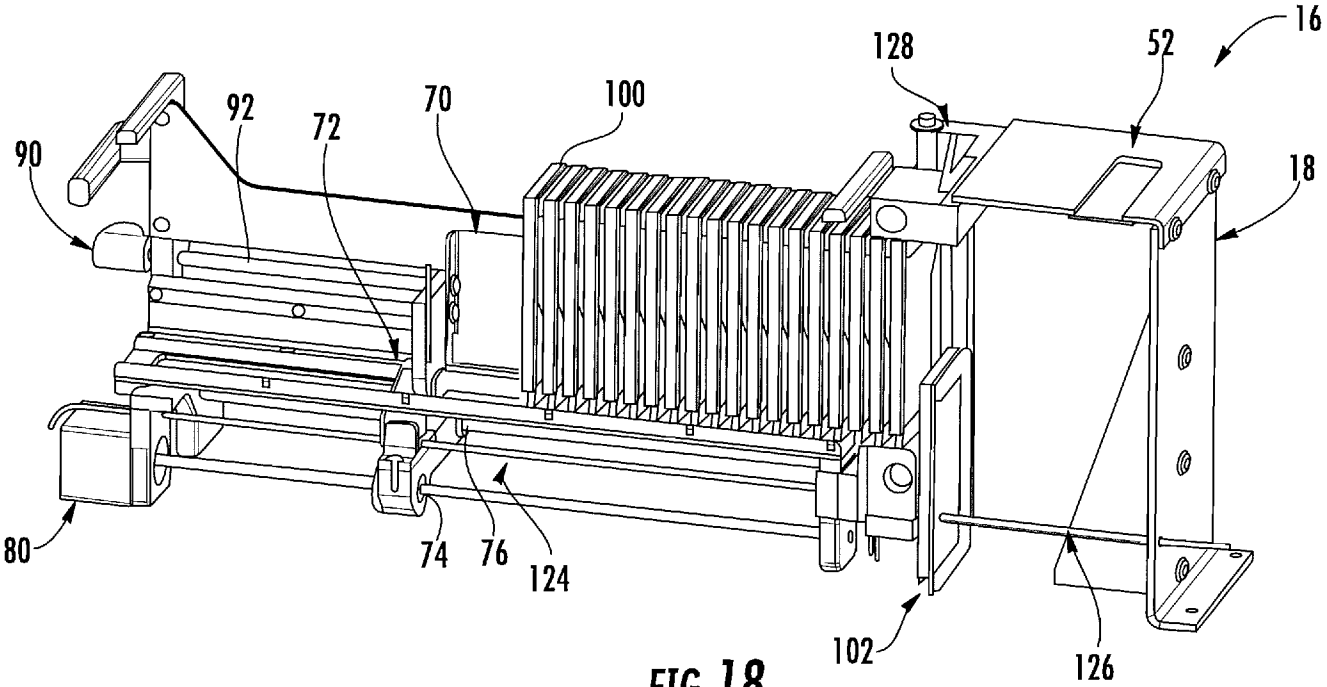
FIG. 18 is a cross-sectional view of the autoloader of FIG. 16 taken at cut 18-18.
Figure 19:
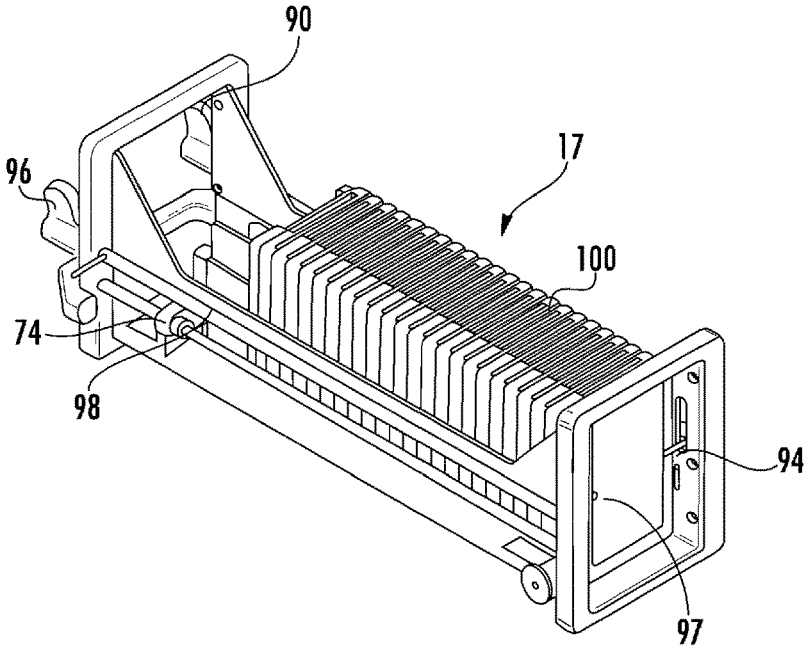
FIG. 19 is a perspective view of an SSD cassette for an autoloader in a locked position.
Figure 20:
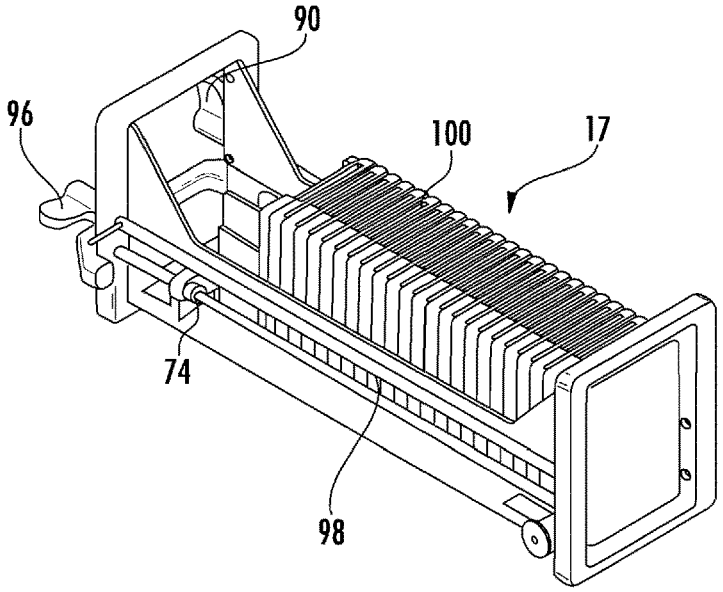
FIG. 20 is a perspective view of an SSD cassette for an autoloader in an unlocked position.
Figure 21:
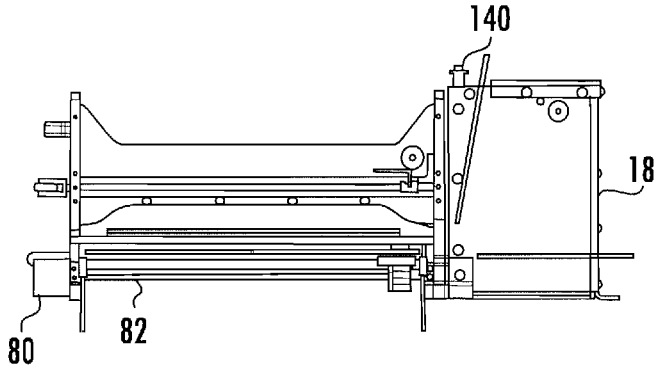
FIG. 21 is a front view of an empty autoloader cassette.
Figure 22:
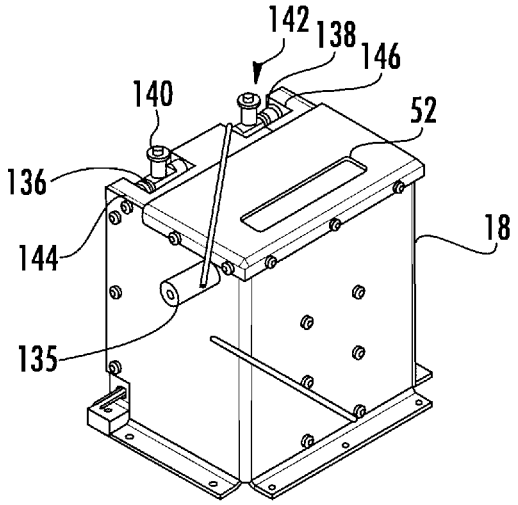
FIG. 22 is a perspective view of the autoloader drop chute.
Figure 23:
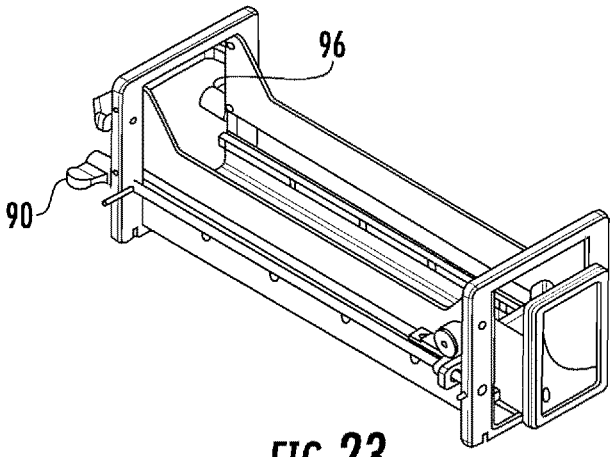
FIG. 23 is a perspective view of the autoloader cassette.
Figure 24:
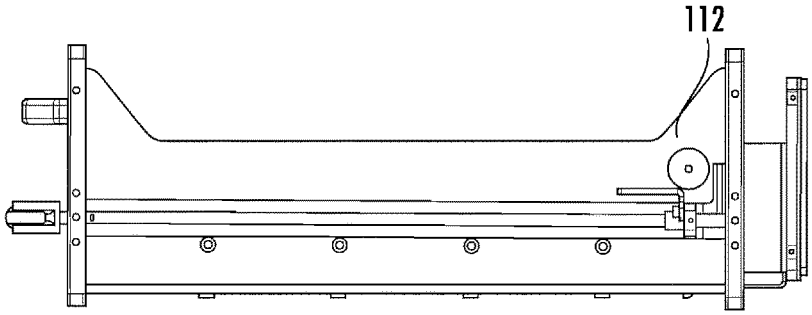
FIG. 24 is a front view thereof.
Figure 25:
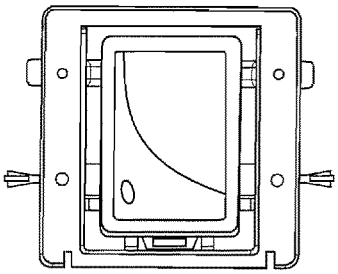
FIG. 25 is an end view thereof.
Figure 26:
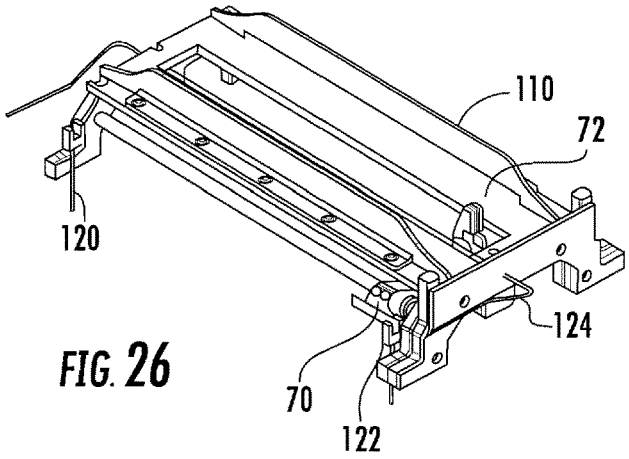
FIG. 26 is a perspective view of the autoloader indexing base.
Figure 27:
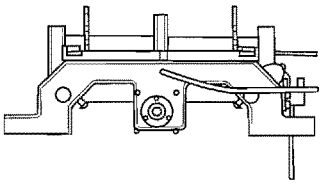
FIG. 27 is a first end view thereof.
Figure 28:
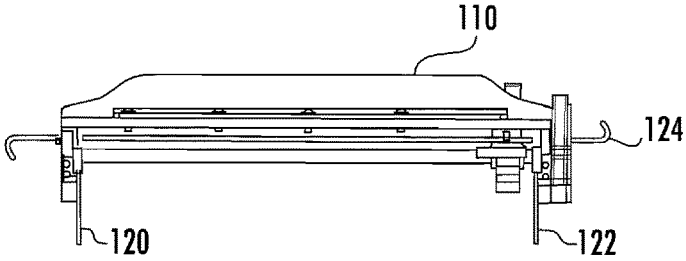
FIG. 28 is a front view thereof.
Figure 29:
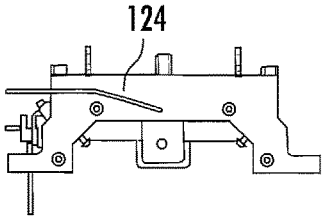
FIG. 29 is a second end view thereof.
Figure 30:
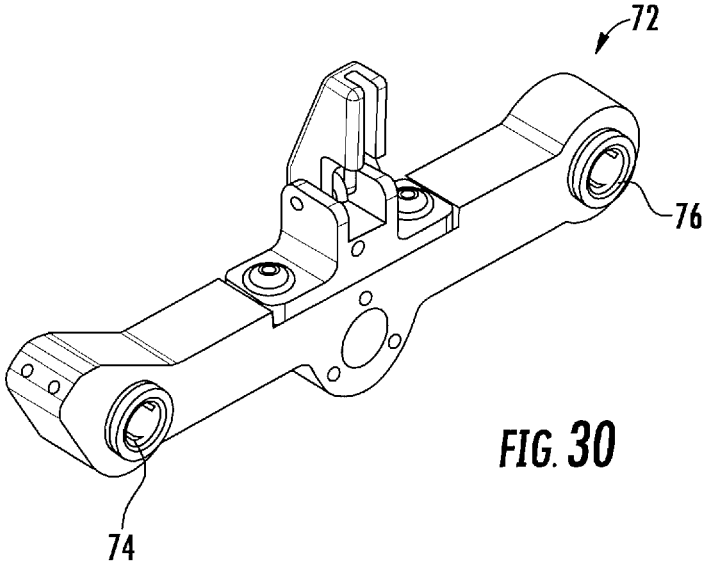
FIG. 30 is a perspective view of the autoloader pusher.
Figure 31:
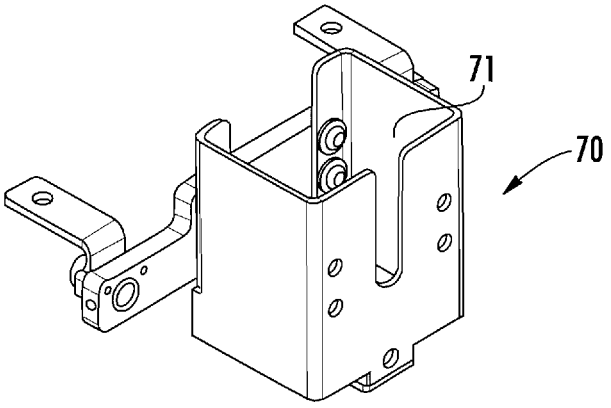
FIG. 31 is a perspective view of the autoloader spacer.
Figure 32:
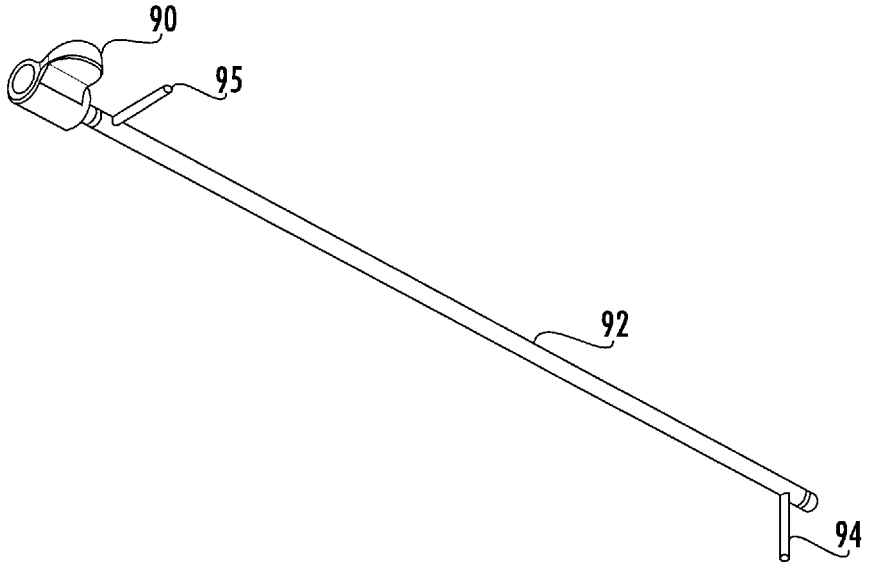
FIG. 32 is a perspective view of the left latching mechanism.
Figure 33:
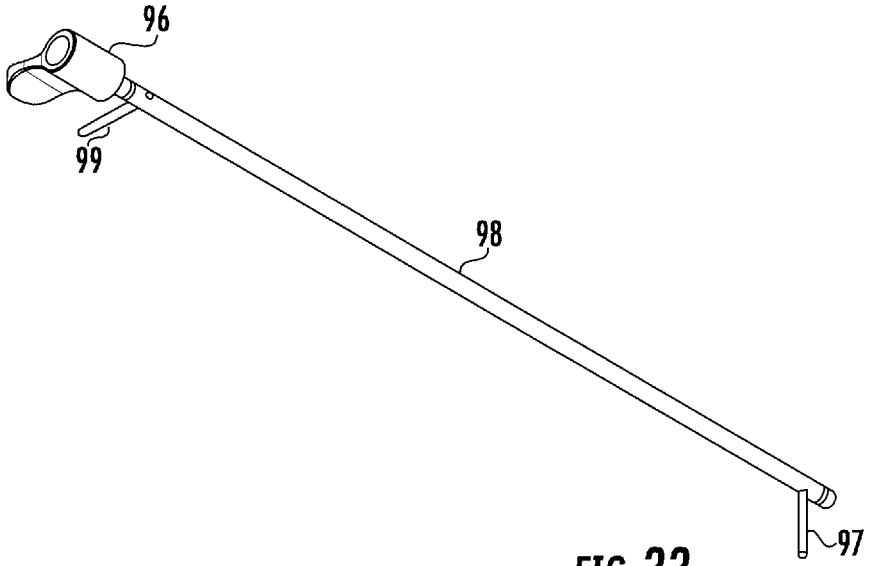
FIG. 33 is a perspective view of the right latching mechanism.
Figure 34:
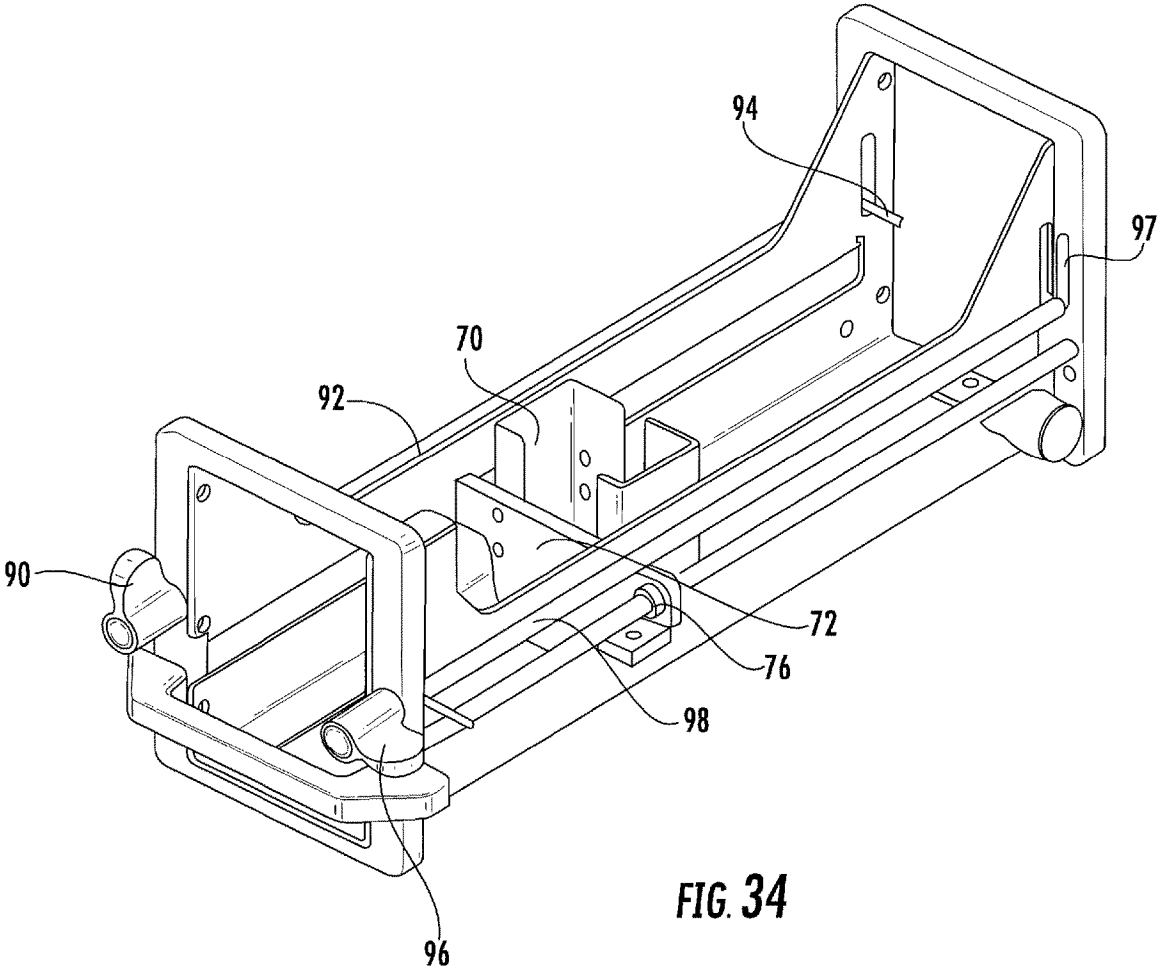
FIG. 34 is a perspective view of an empty autoloader cassette.
Figure 35:
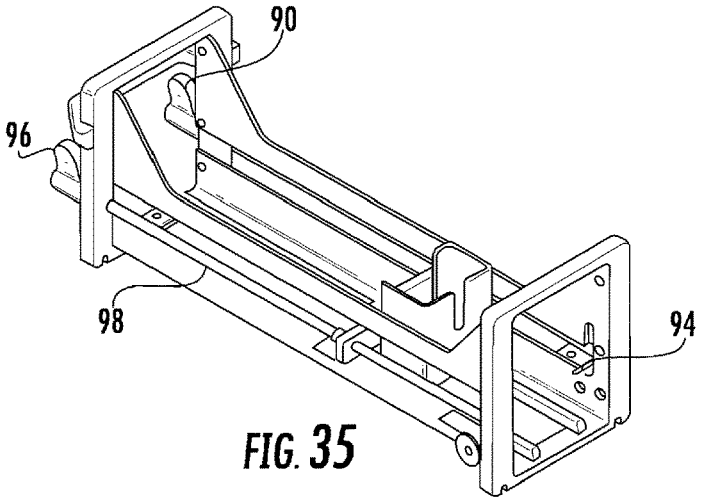
FIG. 35 is an alternate perspective view of an empty autoloader cassette.
Figure 36:
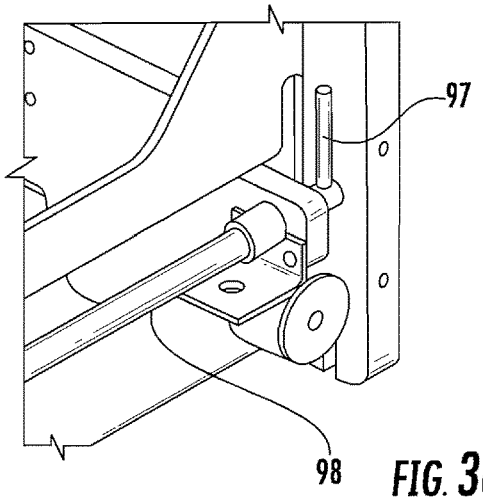
FIG. 36 is a close-up view of the locking mechanism for an autoloader cassette.
Figure 37:
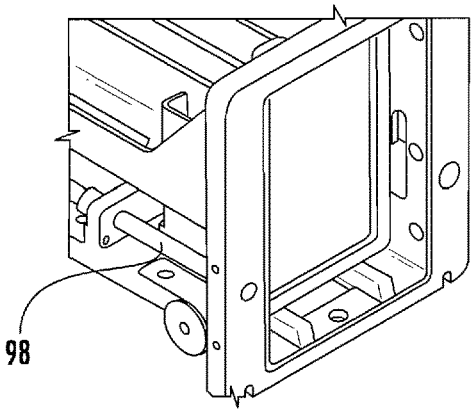
FIG. 37 is a close-up view of the pusher in an empty autoloader cassette.
Figure 38:
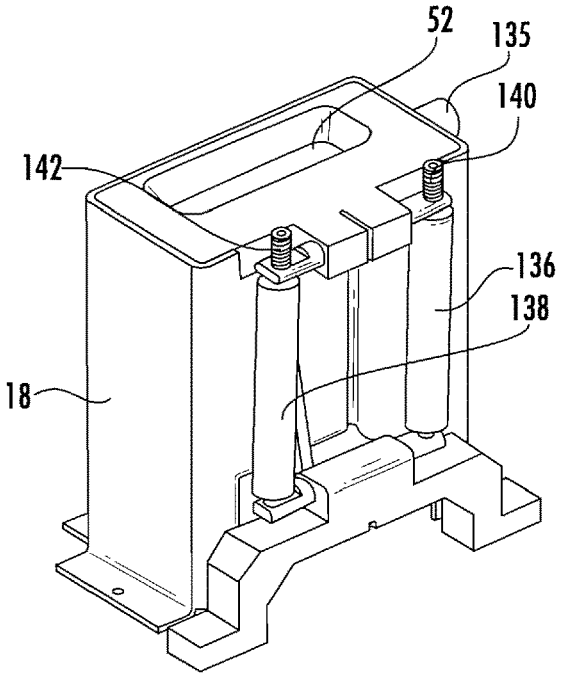
FIG. 38 is a perspective view of a drop chute connection to an autoloader.
Figure 39:
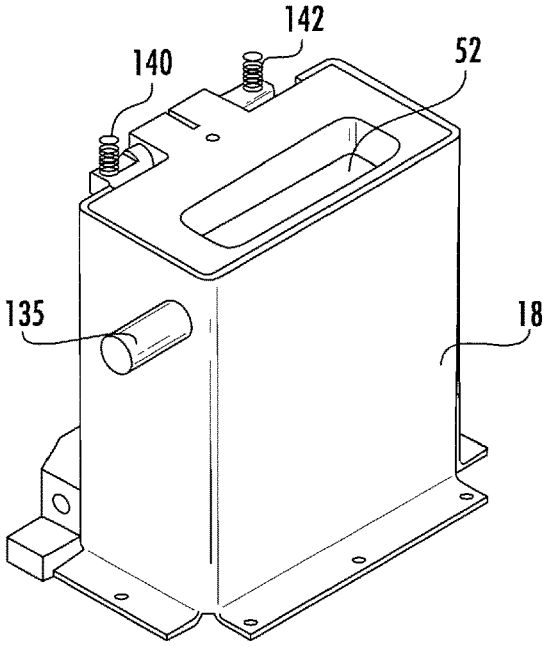
FIG. 39 is an alternate perspective view of FIG. 38.
Figure 40:
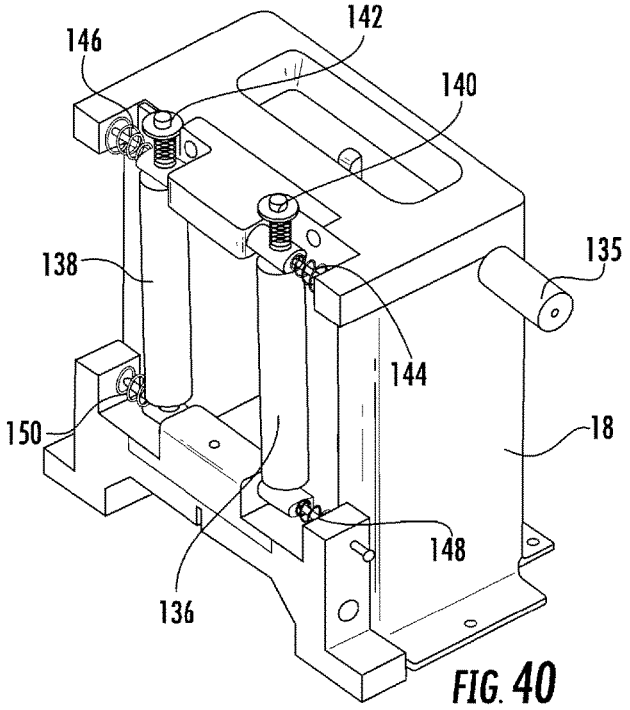
FIG. 40 is an alternate perspective view of a drop chute with an open chute door.
Figure 41:
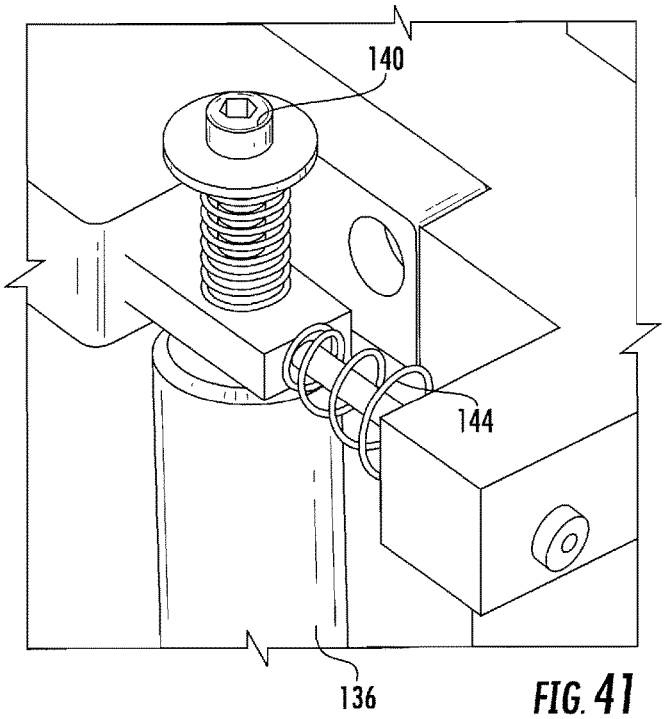
FIG. 41 is a close-up view of the spring load on the pinch roller in a drop chute.
Figure 42:
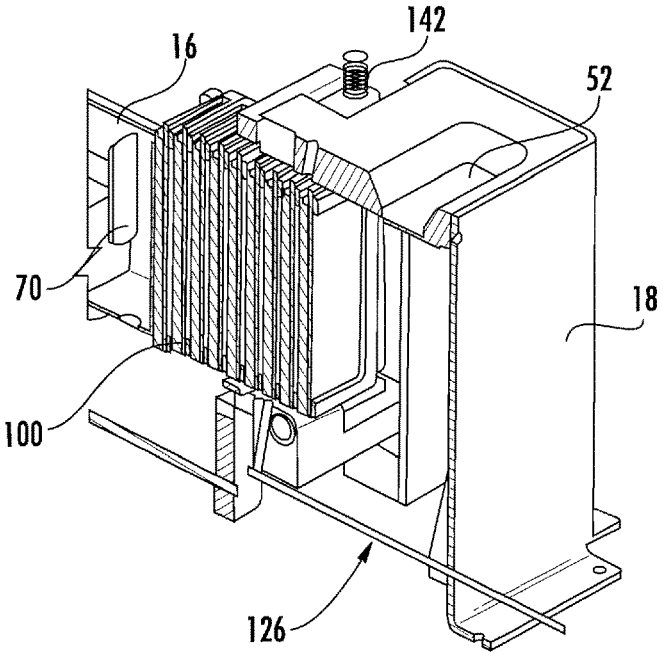
FIG. 42 is a cross-sectional view of a drop chute connection to an autoloader.
Figure 43:
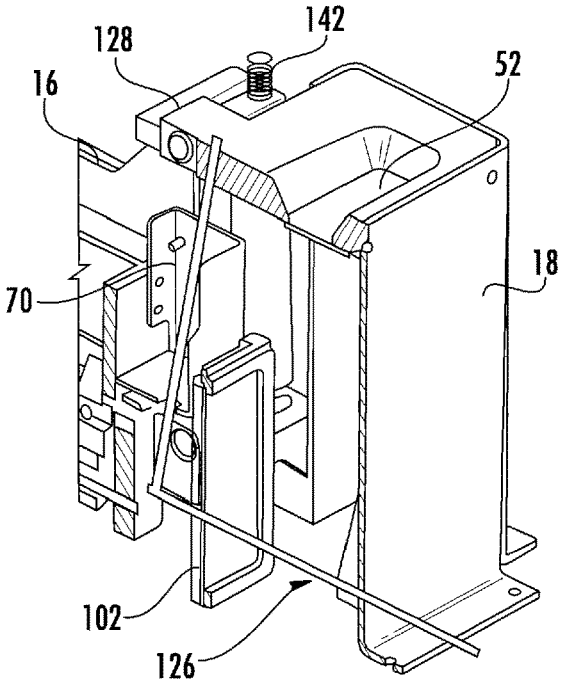
FIG. 43 is a cross-sectional view of a drop chute connection to an emptying autoloader.

Referring to FIGS. 16-43, set forth is the autoloader 16, which consists of a drop chute 18 with a drop chute door 52. For illustration purposes, a plurality of SSDs 100 are placed behind a pusher 70, which is sized to engage the SSDs and is moved by a finger pusher 72. The finger pusher 72 has a first lead screw attachment 74 and second lead screw attachment 76 driven by a stepper motor 80. The stepper motor is operated by the device controller CPU 68, which times placement of the SSDs through the cassette 17 for placement in the drop chute 18; an individual SSD 102 is depicted while being lowered into the drop chute. The cassette 17 includes manual lock knobs 90 and 96. Lock knob 90 includes shaft 92 with end protrusions 94 and 95 for capturing a plurality of disks. The cassette lock knob 90 is placed on one side of the cassette, and is manually rotated to maintain the cassettes in a position for ease of storage, as the cassettes can be pre-loaded and fed into the machine as desired. Second cassette lock knob 96 includes shaft 98 with end protrusions 97 and 99, which allows locking of cassettes on both sides to maintain positioning while in the storage position. The cassette 17 is constructed and arranged to hold up to 50 SSDs. The stepper motor 80 is coupled to the lead screw 82 for engagement of the pusher finger 72.

The pusher 70 can also be used to hold smaller memory devices, such as USB ports, by use of an open chamber 71 that can feed into the drop chute 18 when the larger SSDs placed on the cassette 17 have expired. The cassette 17 rides upon a base 110, which houses the pusher 70 and allows for means of attachment of a substitute cassette, allowing the unit to be run continuously by simply installing replacement cassettes having previously installed solid state drives. A constant force spring 112 operates with the cassette to further eject the SSD's into the drop chute.

The finger pusher 72 operates in conjunction with first limit sensors 120 and 122 and a first through beam sensor 124 to relay to the CPU 68 where the finger pusher 72 is with respect to the cassette 17. The finger pusher 72 is on a pivot, wherein the stepper motor 80 can be disengaged and the finger pusher 72 brought back to the sensing position so as to collect the additional solid state drives. The chute door 52 is operated by a linear solenoid actuator 135.

Pinch rollers 136 and 138 are adjustable by spring loads 140 and 142, respectively. The pinch rollers operate as a check valve to prevent SSDs from entering back into the cassette holder once loaded through chute door 52.

The pinch roller 136,138 further include upper horizontal springs 144 and 146 to allow displacement of the rollers 136,138 during insertion of the SSD. Lower horizontal springs, 148,150, form a mirror image of the upper springs 144, 146, are positioned along the bottom of the pinch rollers 136,138, allowing flexibility and movement of each pinch roller 136,138 to ensure ease of entry of the SSD into the drop chute 18 and prevent backfeeding.

A gap distance is positioned between the blades 34,42 and the cutting blades 36,38, namely a spacing of 0.8 millimeters. A small spacing is important to the operation of the device to provide proper shearing at the low rpm rotor rotation, with minimal rotor lag. The cutting blades 36, 38 are adjustable to maintain this gap, and should allow proper disintegration of SSDs for approximately 100,000 cycles. A second important gap or spacing is between the blades 32 and 42 in relation to the 2 mm apertures 22 of the continuous side wall 11. These gaps are important to this invention for desired operation. The spacing for the second gap strategically positions the rotor blades 34,44 at a distance of 0.4 mm from the chamber sidewall 11, having apertures 22 so as to cause shredded material to pass through the apertures 22.

Sensors are used with fiber optic through beams 124,126, 128 to detect when the cassette 17 is loaded and when the cassette 17 stack is empty and relay that information to the CPU 68. As previously described, the first through-beam 124 registers the location of the pusher 72 relative the sensors 120,122 along a longitudinal axis of said autoloader cassette 17. The second through-beam 126 is located within the drop chute 18 to register when a SSD is falling through the drop chute 18. As a SSD passes through the drop chute 18 the second through-beam 126 is temporarily blocked, alerting the CPU 68 to a falling item.

The third through-beam 128 is located partially within the drop chute 18 and partially along the longitudinal axis of the autoloader 16. The third through-beam 128 is blocked until the autoloader cassette 17 is emptied, which thereby allows the third through-beam 128 to establish its connection and register for the CPU 68 that the autoloader 16 is empty.

All patents and publications mentioned in this specification are indicative of the levels of those skilled in the art to which the invention pertains. It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A device for disintegrating solid state drives (SSD's) comprising:

a housing having a chamber, said chamber formed by a continuous chamber sidewall, said chamber sidewall having a plurality of apertures with at least one cutting knife extending into said chamber through one said aperture;

an autoloader mounted to said housing, said autoloader having a removable cassette capable of positioning a plurality of SSD's for timed introduction into a drop chute, said drop chute constructed and arranged to drop said plurality of SSD's into said chamber at a preprogrammed rate, said cassette including a manual locking mechanism using rotatable protrusions to block movement of the SSD's, and a cassette pusher movable along a grid support to dispense said plurality of SSD's into said drop chute when said protrusions are in an unlocked configuration, said cassette pusher moved by a stepper motor timed to introduce said plurality of SSD's into said drop chute at said preprogrammed rate, a blade assembly positioned in said chamber beneath an outlet of said drop chute, said blade assembly comprising a first rotor offset from a second rotor, said first and second rotor offset constructed and arranged so that upon introduction of individual SSD placed through said drop chute, said individual SSD will impact said first and second rotors in conjunction with said at least one cutting knife to cause shearing of said individual SSD;

a flywheel coupled to said blade assembly;

a motor coupled to said flywheel to provide rotation of said blade assembly, said motor electrical coupled to a rotation sensor to maintain rotation of said blade assembly at a preprogrammed cutting rpm; and a holding area for collection of material passing through said plurality of chamber sidewall apertures, said holding area including an exhaust attachment to allow disintegrated material to be removed by a vacuum cleaner to permit removal of comminuted material having normal edge dimensions of 2 mm or less.

2. The device according to claim wherein each said rotor has three blades, each said blade having a leading edge placed at a 60 degree angle relative to said at least one cutting knife.

3. The device according to claim 1 wherein said first rotor has three blades offset in relation to said second rotor having three blades, said rotation position constructed and arranged to permit said individual SSD introduced into said chamber to alternately impact said blades secured to each of said first and second rotor, wherein angular positioning of said individual SSD caused by said alternating impact expedites disintegration by shearing said individual SSD between said blades and said cutting knives extending through said chamber sidewall.

4. The device according to claim wherein said preprogrammed rate of introduction of said plurality of SSD's into said drop chute is a rate of about 1 SSD every 10 seconds.

5. The device according to claim 1 wherein said flywheel weighs 45 kgs.

6. The device according to claim 1, wherein a control circuit-turns off said motor when the blade assembly preprogrammed cutting rate is about 520 RPM's.

7. The device according to claim 1, wherein a control circuit turns off said motor when the blade assembly preprogrammed cutting rate is greater than 600 RPM's for at least 60 seconds.

8. The device according to claim 1, wherein a control circuit reverses rotation of said blade assembly when the blade assembly is detected as jammed.

9. The device according to claim 1, wherein said blade assembly is spaced apart from said cutting blades by 0.8 mm.

10. The device according to claim 1, wherein said blade assembly is spaced apart from said chamber sidewall containing apertures by 0.4 mm.

11. The device according to claim 1, wherein said chamber sidewall containing apertures is a screen with 2 mm apertures.

12. The device according to claim 1, wherein said motor is 5 HP.

13. The device according to claim including a chute door providing access to said chamber bypassing said autoloader when said cassette is empty.

14. The device according to claim 13 wherein said chute door is operated by a solenoid.

15. The device according to claim 1 further including a Central Processing Unit (CPU) electrically coupled to said motor and said stepper motor.

16. The device according to claim 15, wherein said autoloader includes a first through-beam electrically coupled to said CPU to locate said pusher relative to a longitudinal axis of said autoloader cassette.

17. The device according to claim 15, wherein said drop chute includes a second through-beam electrically coupled to said CPU, said second through-beam identifying for said CPU when an item is passing through said drop chute.

18. The device according to claim 15, wherein said autoloader includes a third though-beam electrically coupled to said CPU, said third through-beam identifying when said autoloader cassette is empty.

* * * * *